US007641536B2

(12) United States Patent
Fildan et al.

(10) Patent No.: US 7,641,536 B2
(45) Date of Patent: Jan. 5, 2010

(54) BRASSIERE CONSTRUCTION

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 731 days.

(21) Appl. No.: 11/296,581

(22) Filed: Dec. 7, 2005

(65) Prior Publication Data

US 2007/0128980 A1 Jun. 7, 2007

(51) Int. Cl.
*A41C 3/00* (2006.01)

(52) U.S. Cl. ..... 450/72; 450/73; 450/25; 450/26; 450/28; 24/697.1; 24/592.1; 24/DIG. 43; 24/DIG. 49; 2/96

(58) Field of Classification Search ..... 450/13, 450/14, 17, 18, 25, 26, 28, 34, 35, 72, 73, 450/80, 82, 1; 2/96, 141.1, 141.2, 219, 235, 2/236, 321, 322, 257, 265, 263, 264, 336, 2/338; 24/697.1, 697.2, 592.1, DIG. 43, 24/49

See application file for complete search history.

(56) References Cited

U.S. PATENT DOCUMENTS

| | | | | |
|---|---|---|---|---|
| 2,802,215 | A * | 8/1957 | Alfandre | 112/407 |
| 3,066,310 | A * | 12/1962 | Roseman | 2/265 |
| 3,528,140 | A * | 9/1970 | Waldes | 24/695 |
| 6,321,419 | B1 * | 11/2001 | Fildan et al. | 24/114.6 |
| 6,347,438 | B1 * | 2/2002 | Fildan et al. | 24/662 |
| 6,875,075 | B2 * | 4/2005 | Rossi et al. | 450/13 |

* cited by examiner

*Primary Examiner*—Gloria Hale
(74) *Attorney, Agent, or Firm*—Andrew Wilford

(57) ABSTRACT

Wings attached to form the back panels of a brassiere are provided with the male and female fastener elements in the form of patches by ultrasonic welding of the patches to the diecut fabric wings. The male and female fastener elements are preferably of the snap type hook and eye plastic fastener elements which can be injection molded or ultrasonically bonded to the patches.

24 Claims, 8 Drawing Sheets

BRASSIERE CONSTRUCTION

CROSS REFERENCE TO RELATED APPLICATIONS

This application is related to the copending application Ser. No. 10/978,238 filed 29 Oct. 2004 entitled Laminated Brassiere Wing and application Ser. No. 11/025,679 filed 28 Dec. 2004 and was entitled "Laminated Brassiere Wing". Applicant claims the benefit of these earlier applications under 35 USC 120.

FIELD OF THE INVENTION

Our present invention relates to a brassiere construction in which a pair of brassiere wings can be attached to a cup structure and can form the back of the brassiere. The wings are provided with fastener elements which allow them to be detachably engaged with one another to form a closed back and to be opened to permit the garment to be put on or taken off.

The invention also relates to a method of making a brassiere.

BACKGROUND OF THE INVENTION

In the aforementioned applications, we have described the formation of brassiere wings with the fastener elements which can be attached as units to a cup structure to form the back of a brassiere. The shoulder straps may be connected between that cup structure and these wings and the fastener elements on the wings are preferably combined press button and hook fasteners which can be engaged by the insertion of a head of the male member into the recess formed by a notch in the female member. The fasteners which have been described as injection molded synthetic resin snap-type hook and eye connectors and are of the type described in U.S. Pat. No. 6,557,232, were injection molded directly on the laminated wings. The fasteners have the advantage that they can be engaged via an action similar to that used to engage standard hook and eye connectors, but can be separated by being pulled apart perpendicularly to the wings like a snap fastener.

The aforementioned patent and copending applications are incorporated by reference herein in their entirety.

It has been found that the laminated brassiere wings of the prior applications can be improved upon.

OBJECTS OF THE INVENTION

It is, therefore, the principal object of the present invention to provide an improved wing structure for use in the production of a brassiere which is less expensive to manufacture and more easily used and more comfortable than prior wing systems.

Another object of the invention is to provide an improved method of making a brassiere and an improved brassiere.

SUMMARY OF THE INVENTION

These objects and others which will become apparent hereinafter are attained, in accordance with the invention, with a brassiere wing to form a back of a brassiere, the brassiere wing comprising:

an elongated substantially elastic member having one end attachable to the cup structure and an opposite end;

a substantially inelastic patch secured to the opposite end;

at least one fastener element of a brassiere back fastener mounted on the patch and detachably engageable with a mating fastener element on the other brassiere wing; and an attachment line around a periphery of the patch for securing the patch to the brassiere wing.

The brassiere can comprise, therefore:

a cup structure;

a pair of brassiere wings connected to opposite sides of the cup structure and detachably connectable to one another to form a back of the brassiere, each of the brassiere wings comprising:

an elongated substantially elastic member having one end attachable to the cup structure and an opposite end, a substantially inelastic patch secured to the opposite end, at least one fastener element of a brassiere back fastener mounted on the patch and detachably engageable with a mating fastener element on the other brassiere wing, and an attachment line around a periphery of the patch for securing the patch to the brassiere wing; and respective shoulder straps connected between each of the wings and a cup of the structure.

The method of making the brassiere comprises the steps of:

(a) die cutting or ultrasonically cutting from a piece of fabric an elongated elastic brassiere wing adapted to be attached to a cup structure and detachably connectable to another brassiere wing to form a back of a brassiere, the brassiere wing having one end attachable to the cup structure and an opposite end;

(b) forming a substantially inelastic patch with at least one fastener element of a brassiere back fastener detachably engageable with a mating fastener element on the other brassiere wing;

(c) securing the patch to the opposite end of the brassiere wing by an attachment line around a periphery of the patch; and (d) thereafter securing the wing to the cup structure.

While the elastic member from the brassiere wing is diecut from a piece of fabric and has soft edges free from hemming, the piece of fabric may itself be a fabric laminate if a single fabric layer has insufficient body to form the back panel of the brassiere. Ultrasonic cutting also can leave a soft edge. Indeed the invention will be effective with any cutting operation that leaves the edges of the wing soft. The substantially inelastic patch which is secured to the diecut member itself is composed of a piece of that fabric laminate which, in turn, is preferably laminated to an additional layer which is inelastic and can be welded to the elastic member or around the perimeter of the patch to form the attachment line. Preferably, as noted, the fastener is of the hook and eye type and can, in one embodiment, be a conventional hook and eye fastener although preferably the fastener is of the snap type or press button hook and eye type injection molded onto the patch. Preferably further attachment lines are provided between the patch and the wing between the rows of fastener elements.

The result is a snap type hook and eye patch ultra-sonically bonded to the wing fabric and because it is slightly smaller than the wing, is surrounded by soft edges along all three sides of the wing at the free end thereof, the other side of the wing being affixed to the cup structure. During the process of patching, the two laminated fabrics together form a cushion which can be on the inside or outside of the wing without requiring any additional cushion layer between the two. The weld lines between the rows of female fastener members or studs can form cushions on either side of the wing.

The patch has the advantage that a piece of the fabric used to form the wing itself may provide the visible surface of the patch. The patch wing can be used in a so-called T-shirt brassiere where the wings are made of laminated elastic fabric without any seams and usually of a polyamide fabric or other synthetic or mixed fabric which is ultrasonically weldable. The advantage of the laminated fabric is that it does not fray after diecutting and has soft edges which are comfortable for the user. The material from which the wing layer is diecut and from which a piece is removed to form the patch is normally laminated by many small dots (dot lamination) between the fabric layers or with a film of polyurethane, which may or may not be air permeable, therebetween.

In practice, the brassiere manufacturer will decide what material and color he will provide to a laminator and receive the laminated fabric from the laminator. The manufacturer can then diecut the wings from the fabric returned from the laminator and forward a piece of that material to still another firm for injection molding of the fastener elements onto the patches. The patches would then be applied by the brassiere manufacturer using an ultrasonic tool forming the attachment lines as noted. The patch manufacturer can itself make the patch inelastic by laminating a polyurethane film of low elasticity or an inelastic polyamide mesh to one side of the patch. The patches can be stamped out from the three layer laminate and are always at least 2 to 3 mm or about ⅛ inch smaller than the wing itself to provide the soft edges desired along the periphery of the wing. The synthetic resin fastener elements can be injection molded into the patch when a thin patch is desired or ultrasonically bonded to the patch as desired.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
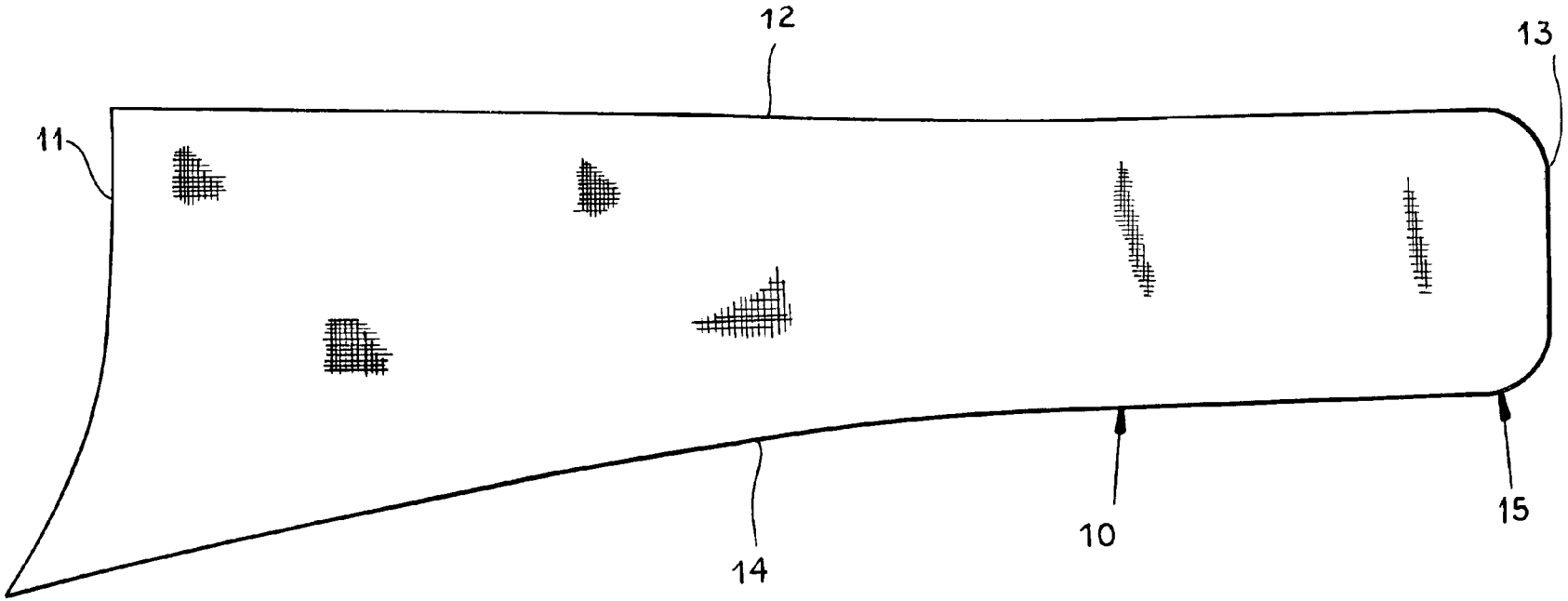
FIG. 1 is an elevational view of a diecut fabric piece forming the basic structure of a brassiere wing according to the invention.
Figure 2:
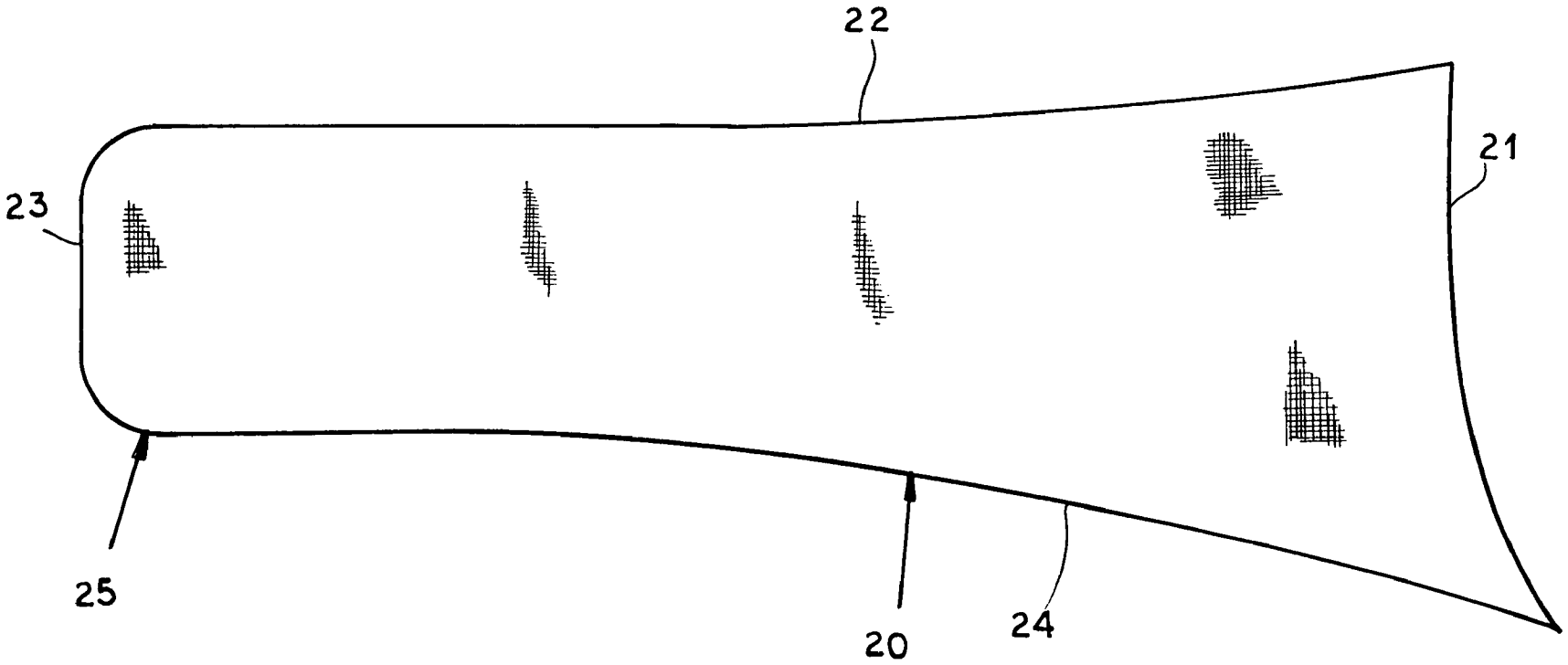
FIG. 2 is a view similar to FIG. 1 of the other wing.

In FIG. 1 we have shown a diecut fabric piece adapted to form one wing defining the back panels of a brassiere and having a rounded end 11 connectable with the cup structure and three diecut edges 12, 13 and 14 which represent soft edges and which are not hemmed, seamed or otherwise finished. The fabric can be a single layer if of sufficient body to form a back panel or laminated from two or more layers, e.g. by dot lamination. The member 10 is formed from elastic fabric, for example, of a polyamide yarn which is ultrasonically weldable.

Similarly, the other brassiere wing has a rounded side 21 and diecut edges 22, 23, 24 which are soft and unhemmed. It too is laminated if necessary from two or more fabric layers to provide sufficient body to form the brassiere back panel if a single fabric layer has insufficient body.

The wing members 10 and 20 have free ends 15 and 25 which are to be provided with the back fasteners as noted.

Figure 3:
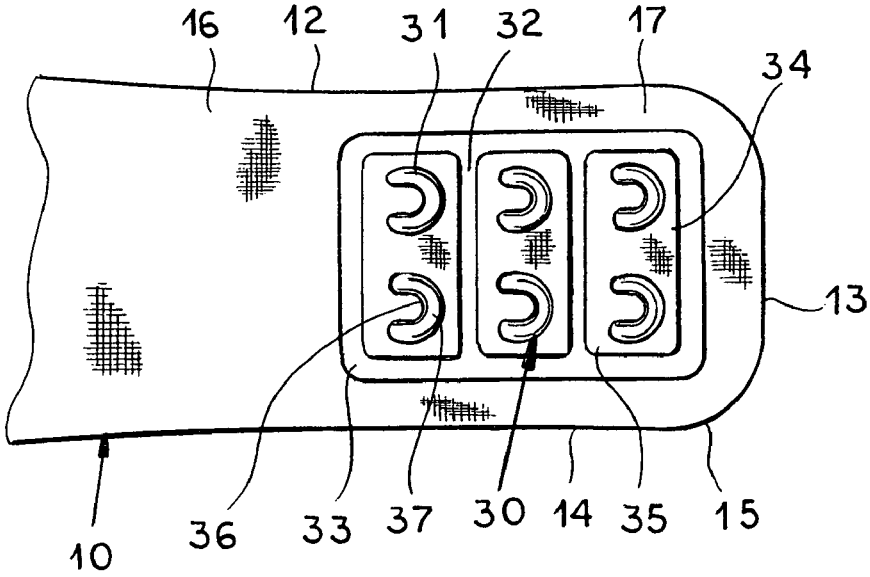
FIG. 3 is a diagrammatic elevational view of an end of a wing provided with a patch carrying the female fastener elements according to the invention.
Figure 4:
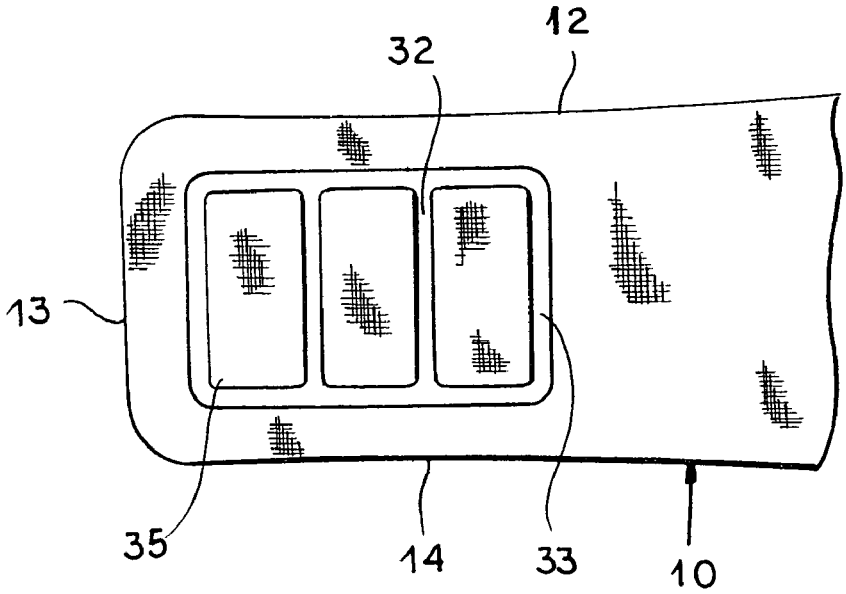
FIG. 4 is a view of the wing end shown in FIG. 3 from the opposite side.
Figure 8:
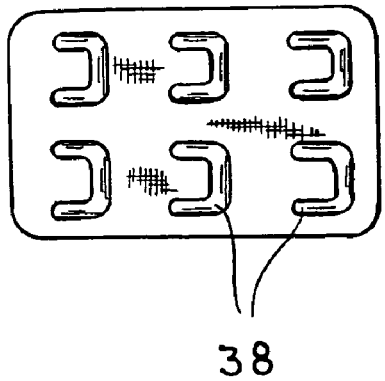
FIG. 8 is a view of the opposite side of this patch.
Figure 9:
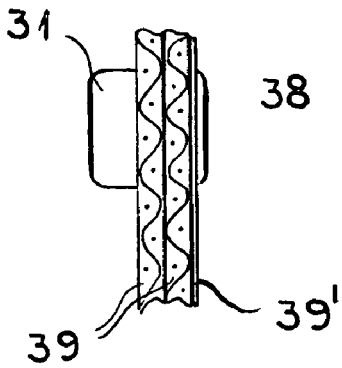
FIG. 9 is a diagrammatic section through the patch.

More particularly, as can be seen from FIG. 3, a patch 30 can be affixed to the inside surface of the free end 15 of the wing member 10 and comprises a laminate (see FIGS. 7 to 9), to which female fastener members 31 are secured by injection molding or ultrasonic bonding. The members 31 are provided in rows separated by ultrasonic weld attachment lines 32 which merge with a parameter weld 33 extending all around the patch 30. The material 16 of the wing 10 visible in FIG. 3 is the same material as is shown at 34 of the patch. The patch 34 lies inwardly of the edges 12, 13 and 14 of member 10 so that the region 17 between these edges and the patch remains soft and pliable. As can be seen from FIG. 4, the ultrasonic weld lines 32 and 33 on the other side of the wing 10 mark the boundary of the patch and the compartments 35 containing the fastener elements 31. The compartments 35 form cushions both on the inside (FIG. 3) and the outside (FIG. 4) when the compressed regions formed by the ultrasonic weld lines 32 and 33 are formed. The female fastener elements 31 can be of the type described in the aforementioned patent, having notch 36 in which a head 41 of a male fastener element 42 (FIG. 6) can engage so that they head extends into a recess below the stud 37 overhanging that recess.

Figure 5:
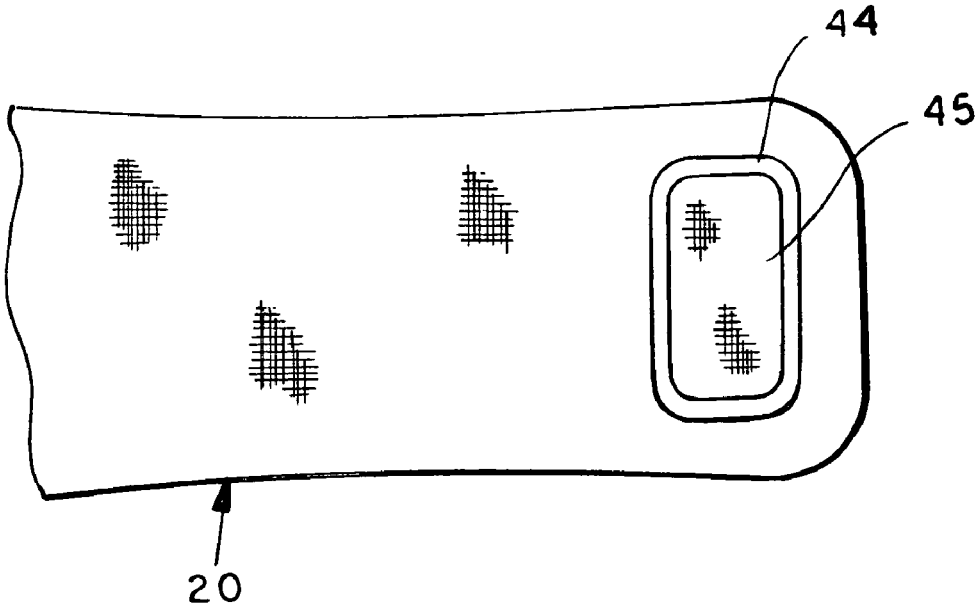
FIG. 5 is an elevational view of a wing end along the inner side carrying the patch with the male fastener element.
Figure 6:
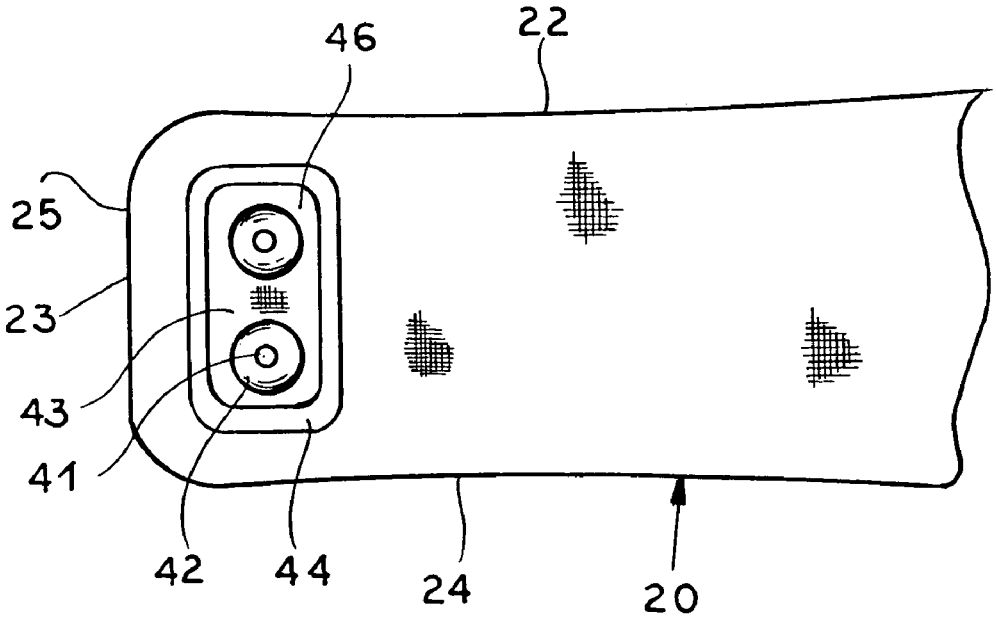
FIG. 6 is a view of the opposite side of this wing and showing the patch with the male fastener elements.

In FIG. 6, two male fastener elements 42 of the type described in that patent are provided on the laminated patch 43 patented by the ultrasonic weld line 44 attaching that patch to the outer surface of the end 25 of the wing 20 inwardly of the edges 22, 23 and 24 thereof so that those edges remain soft and pliable. The weld line 44 is apparent from the opposite side shown in FIG. 5 so that a cushion 45 formed on the inner side of the wing. While a similar cushion at 46 is formed on the outer side. The heads 41 can hook into a pair of the female fasteners 31 but can be separated therefrom simply by pulling the patches apart.

Figure 7:
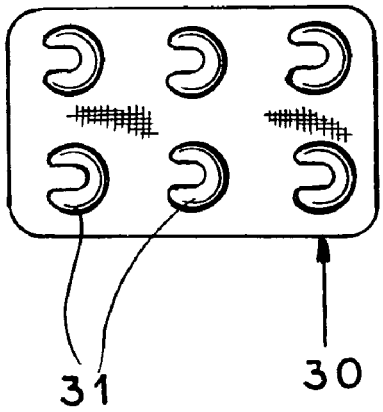
FIG. 7 is an elevational view of a patch carrying the female elements before attachment to the respective wing.

As can be seen from FIG. 7 the patch 30 can be formed with the female studs 31 anchored by the backings 38 by injection molding through the patch or can be ultrasonically bonded to the patch. In practice, the wings 10 and 20 will be diecut by the brassiere manufacturer while a piece of material from which the wings are cut can be forwarded to a patch manufacturer who can apply the studs 31 by injection molding or the like. The patch 30, as will be apparent from FIG. 9 can be laminated from two layers 39 of fabric and a further layer 39' of, for example, an inelastic polyurethane can be bonded to the laminate 39 before the fastener elements are applied. The male fastener patch may be of similar construction.

Figure 10:
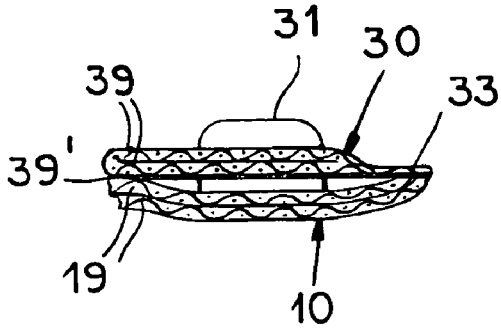
FIG. 10 is a section showing a portion of this patch attached to the layer of underlying laminated fabric.

As can be seen from FIG. 10, the patch 30 with its three layer laminate 39, 39' and its fasteners 31 can be bonded to the laminated fabric 10, made up of layers 19 by ultrasonic welding, e.g. at 33.

Figure 11:
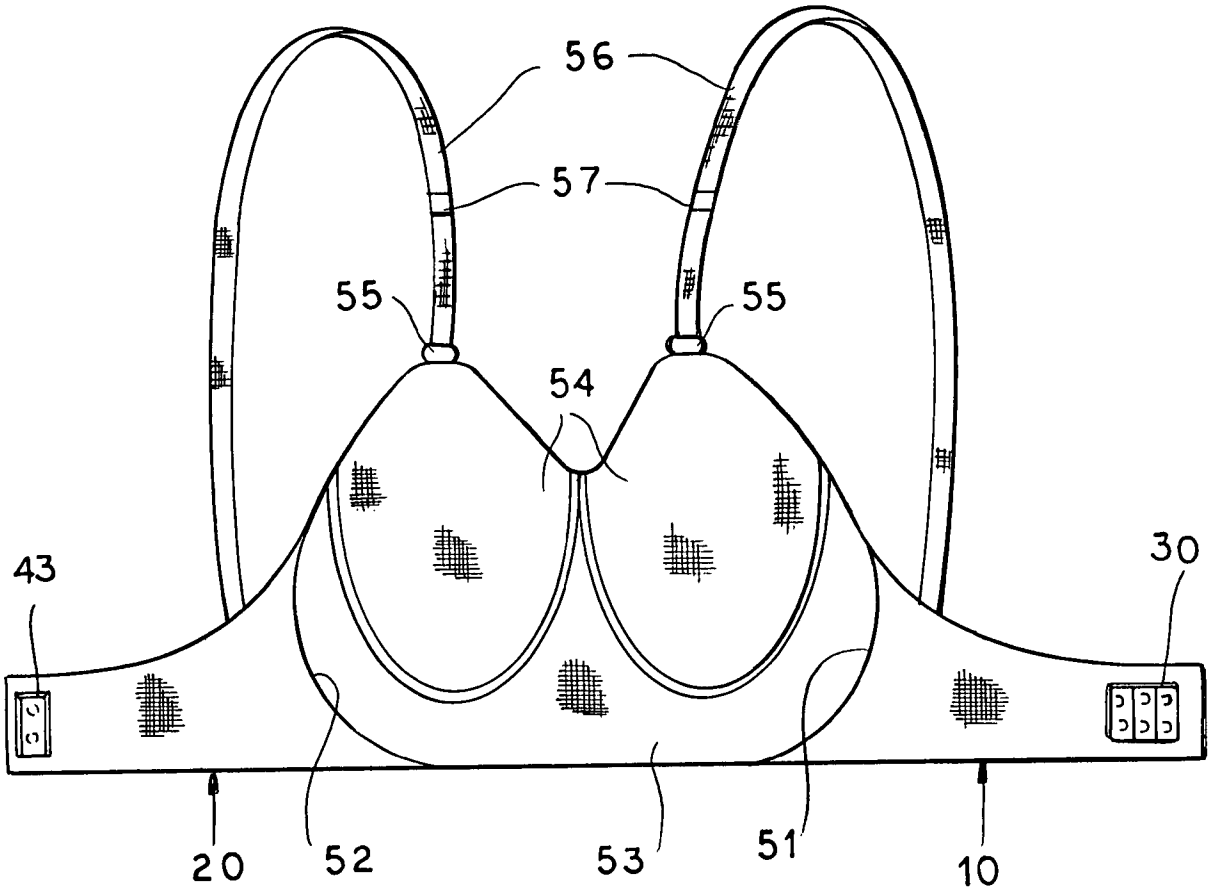
FIG. 11 is an elevational view of a brassiere provided with the wings of FIGS. 1 and 2 or 3 and 6.

In FIG. 11, I have shown the wings 10 and 20 with the patches 30 and 43 connected by ultrasonic welding at 51 and 52 to a cup structure 53 comprising a pair of cups 54. The cups can have eyes 55 at which shoulder straps 56 with adjustment buckles 57 are connected to the wings 10 and 20.

Figure 12:
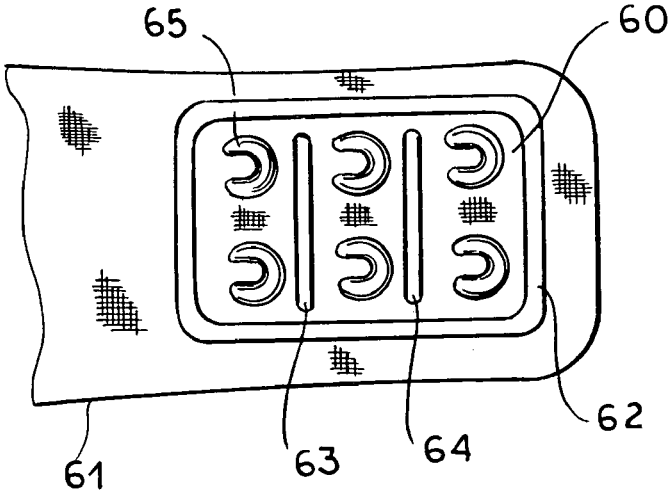
FIG. 12 is a view similar to FIG. 3 of another embodiment of the invention.
Figure 13:
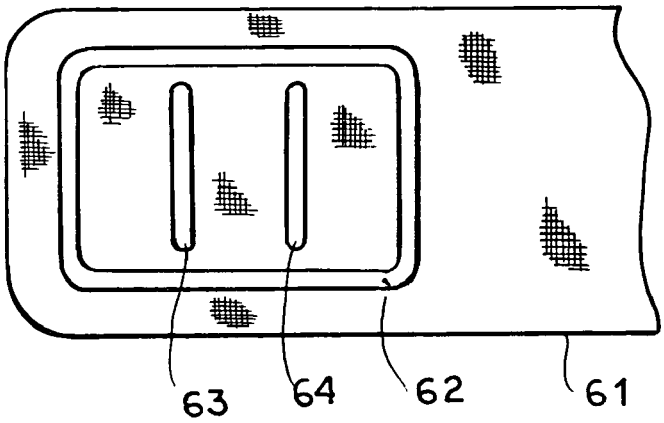
FIG. 13 is a view of the opposite side of this wing showing the ultrasonic weld lines thereof.

In FIGS. 12 and 13, I have shown a patch 60 attached to the free end of a wing 61 by a parameter ultrasonic weld 62 and a plurality of ultrasonic welds 63, 64 separating the rows of fastener elements 65 from one another. The weld lines 63 and 64 do not here reach the perimeter weld 62.

Figure 14:
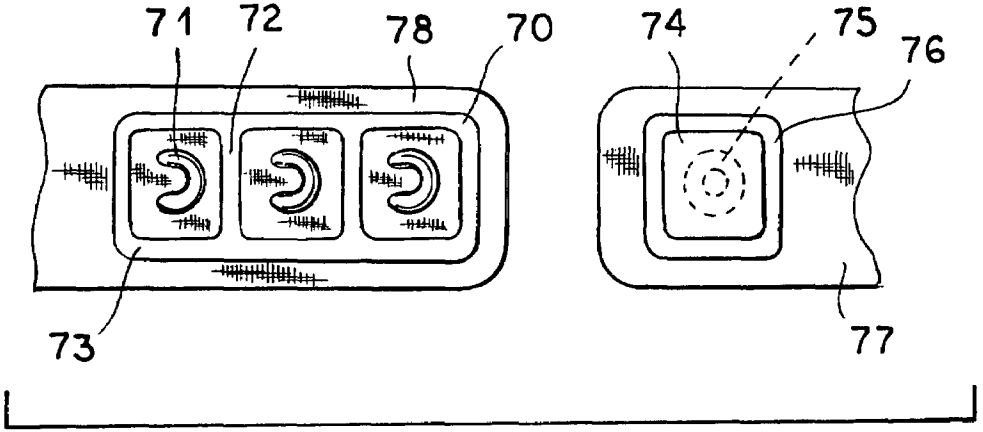
FIG. 14 is a view showing the male and female members in accordance with another embodiment of the invention.

In FIG. 14, the patch 70 has a plurality of the female elements 71 separated by weld lines 72 and a perimeter weld 73 merging therewith.

Figure 15:
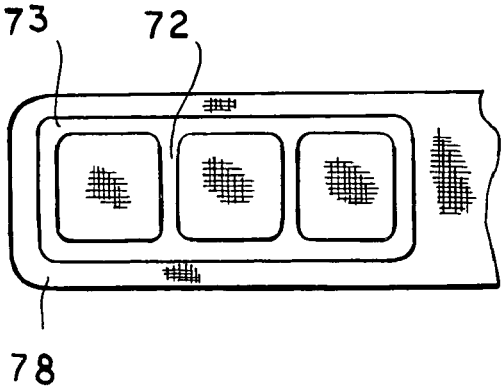
FIG. 15 is an elevational view of the opposite side of the wing carrying the female fastener elements.

The patch 74 of the male fastener element 75 is surrounded by the perimeter weld 76 on the other wing 77. The back of the wing 78 carrying the female fastener elements has been shown in FIG. 15.

Figure 16:
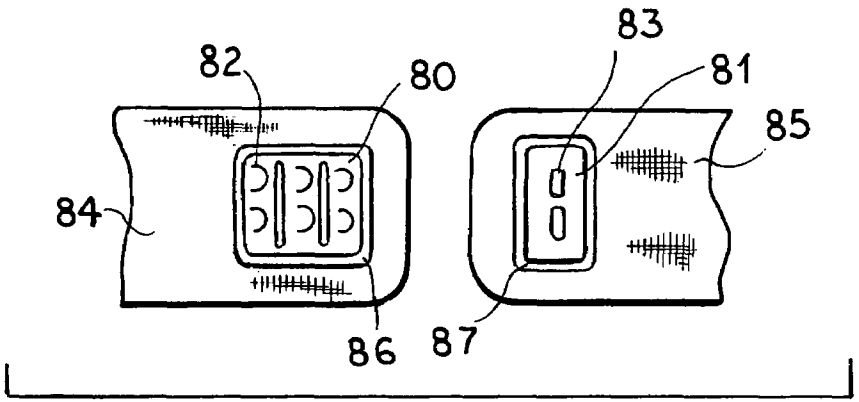
FIG. 16 is a view similar to FIG. 14 but in which conventional hook and eye fastener elements are used rather than the synthetic resin snap type hook and eye elements of FIGS. 1 through 15.

FIG. 16 shows that instead of snap type hook and eye fastener elements, the female patch 80 and the male patch 81 can carry loop type eyes 82 and metal or plastic hooks 83 engageable therewith but can be applied to the wings 84 and 85 by ultrasonic welds 86 and 87 in the manner previously described.

We claim:

1. A brassiere wing adapted to be attached to a cup structure and detachably connectable to another brassiere wing to form a back of a brassiere, said brassiere wing comprising:

an elongated substantially elastic member having one end attachable to said cup structure and an opposite end;

a substantially inelastic patch secured to said opposite end;

at least one first fastener element of a brassiere back fastener mounted on said patch and detachably engageable with a mating second fastener element on said other brassiere wing; and attachment means extending along an attachment line around a periphery of said patch for securing said patch to said brassiere wing.

2. The brassiere wing defined in claim 1 wherein said member is a cut piece of fabric having soft edges free from hemming.

3. The brassiere wing defined in claim 1 wherein said member is composed of a fabric laminate.

4. The brassiere wing defined in claim 1 wherein said attachment means is a weld extending on the attachment line all around said patch.

5. The brassiere wing defined in claim 1 wherein said back fastener is a hook and eye fastener.

6. The brassiere wing defined in claim 1 wherein said back fastener is a press button fastener.

7. The brassiere wing defined in claim 1 wherein said first element is injection molded onto said patch.

8. The brassiere wing defined in claim 1 wherein the member is made of elastic material and said patch is laminated from at least two layers, one of said layers being a layer of the same material as said member.

9. The brassiere wing defined in claim 1 wherein a plurality of said first elements are provided on said patch in spaced relation along a length of said member, said patch being fixed to said member between said first elements.

10. The brassiere wing defined in claim 1 wherein a plurality of said first elements are provided on said patch in rows extending transversely of said member, attaching lines being provided between said rows between said patch and said member.

11. The brassiere wing defined in claim 1 wherein the attachment line forms a closed figure and a cushion is defined within said attachment line on at least one side of said member.

12. A brassiere comprising:

a cup structure;

a pair of brassiere wings connected to opposite sides of said cup structure and detachably connectable to one another to form a back of the brassiere, each of said brassiere wings comprising:

an elongated substantially elastic member having one end attachable to said cup structure and an opposite end, a substantially inelastic patch secured to said opposite end, at least one first fastener element of a brassiere back fastener mounted on said patch and detachably engageable with a mating second fastener element on said other brassiere wing, and attachment means extending along an attachment line around a periphery of said patch for securing said patch to said brassiere wing; and respective shoulder straps connected between each of said wings and a cup of said structure.

13. The brassiere defined in claim 12 wherein each of said members is a die cut piece of a fabric laminate having soft edges free from hemming.

14. The brassiere defined in claim 13 wherein each of said attachment means is a weld extending along the respective attachment line all around the respective patch.

15. The brassiere defined in claim 14 wherein said back fastener is a hook and eye fastener.

16. The brassiere defined in claim 14 wherein said back fastener is a press button fastener.

17. The brassiere defined in claim 16 wherein said first elements are each injection molded onto the respective patch.

18. The brassiere defined in claim 17 wherein the members are made of elastic material and each of said patches is laminated from at least two layers, one of said layers being of the same material as said member.

19. The brassiere defined in claim 18 wherein a plurality of said first elements are provided on at least one of said patches in spaced relation along a length of the respective member, said one of said patches being fixed to the respective member between said elements.

20. The brassiere wing defined in claim 18 wherein a plurality of said first elements are provided on one of said patches in rows extending transversely of said member, the attachment means being provided between said rows between said one patch and the respective member.

21. The brassiere defined in claim 20 wherein each attachment line forms a closed figure and a respective cushion is defined within each of said attachment lines on at least one side of the respective member.

22. A method of making a brassiere comprising the steps of:

cutting from a piece of fabric an elongated elastic brassiere wing adapted to be attached to a cup structure and detachably connectable to another brassiere wing to form a back of a brassiere, said brassiere wing having one end attachable to said cup structure and an opposite end;

forming a substantially inelastic patch with at least one first fastener element of a brassiere back fastener detachably engageable with a mating second fastener element on said other brassiere wing;

securing said patch to said opposite end of said brassiere wing at an attachment line extending around a periphery of said patch; and thereafter securing said wing to said cup structure.

23. The method defined in claim 22 wherein said piece of fabric is a laminated fabric and said patch is formed at least in part from said piece of fabric.

24. The method defined in claim 22 wherein the patch is secured to the brassiere wing by the step of:

welding together the patch and the wing along the attachment line.

* * * * *